United States Patent [19]

Rozmus

[11] 4,056,368

[45] Nov. 1, 1977

[54] METHOD AND APPARATUS FOR DEGASSING GAS CONTAMINATED PARTICULATE MATERIAL

[75] Inventor: Walter J. Rozmus, Birmingham, Mich.

[73] Assignee: Kelsey-Hayes Company, Romulus, Mich.

[21] Appl. No.: 655,088

[22] Filed: Feb. 4, 1976

[51] Int. Cl.[2] ..... B03C 9/00

[52] U.S. Cl. ..... 55/2; 55/3; 55/100; 55/123; 55/136; 55/150; 55/154; 55/385 R; 55/410; 209/127 R; 134/1; 134/21

[58] Field of Search ..... 55/2, 3, 6, 100, 101, 55/123, 136, 150, 154, 159, 410, 385 R; 209/1, 3, 9, 127 R, 127 C, 143; 317/3, 4; 134/1, 21

[56] References Cited

U.S. PATENT DOCUMENTS

| | | | |
|---|---|---|---|
| 1,871,226 | 8/1932 | Skala | 55/2 |
| 2,216,254 | 10/1940 | Schweitzer, Jr. | 55/101 |
| 3,117,080 | 1/1964 | Krestin et al. | 209/1 |
| 3,212,878 | 10/1965 | Bouteille | 209/3 |
| 3,263,808 | 8/1966 | Schwartz | 209/143 |
| 3,493,109 | 2/1970 | Carta et al. | 55/2 |
| 3,738,828 | 6/1973 | Inoue | 209/3 |

*Primary Examiner*—Frank W. Lutter
*Assistant Examiner*—David L. Lacey
*Attorney, Agent, or Firm*—McGlynn and Milton

[57] ABSTRACT

An apparatus and method are disclosed for cleaning contaminated particulate material, such as, gas contaminated powder metal. Degassification is accomplished by introducing contaminated particulate material into a vacuum chamber which is connected to a vacuum pump. One or more electric fields are produced within the vacuum chamber by applying a potential across one or more sets of electrodes. The electrical field charges the contaminants and excites them so that the contaminants are separated for the particulate material and, in the case of a gaseous contaminant, are more easily removed from the vacuum chamber.

38 Claims, 6 Drawing Figures

METHOD AND APPARATUS FOR DEGASSING GAS CONTAMINATED PARTICULATE MATERIAL

This invention relates to an apparatus for cleaning contaminated particulate material.

This invention has been found to be particularly useful in the field of powder metallurgy, specifically, for preparing metal powders of the superalloy type for consolidation by hot isostatic pressing. Due to the reactive nature of superalloy powders and the necessity for purity or cleanliness, such powders must be produced and maintained in an inert atmosphere or under a vacuum. Since it is much more economical to employ the inert atmosphere approach, this is the most commonly used procedure for protecting reactive powders. Before the powder is consolidated by hot isostatic pressing, however, it is necessary to remove the inert gas from the powder. Removal of the protective inert gas is necessary primarily to prevent porosity in the densified material.

One of the first procedures used to degas a filled container for hot isostatic pressing involved transporting the powder metal under an inert atmosphere, usually argon gas, and filling the hot isostatic pressing container with the powder still under the inert atmosphere. Degassing was accomplished by attaching a vacuum pump to the container to pump out the gas. This procedure requires a great deal of time and only about one pound of powder can be processed per hour. Moreover, this procedure is not very efficient since it relies upon natural diffusion of the argon gas out of the powder toward the vacuum pump. In many instances, and undesirable amount of argon remains in the powder. A later improvement involved heating the transport container to help drive off the argon gas. The thermal energy imparted increases the kinetic energy of the gas and helps separate the gas from the powder. Although more gas is removed by heating the powder, an undesirable amount still remains. Moreover, there is not much of an improvement in processing time since it is necessary to permit the powder to cool before subsequent processing.

A more recent refinement of the degassing procedure involves conducting the contaminated powder through the heated zone of a chamber which is connected to a vacuum pump. Movement of the powder through the heated zone exposes the powder to help avoid physical entrapment of the gas. The thermal energy imparted increases the kinetic energy of the argon gas atoms and thus facilitates their release from the powder. This type of hot degassing can proceed at a faster rate than previous degassing operations, but one problem with this procedure is that it is necessary to heat the powder to temperatures as high as 900° F. Consequently, the powder recovered from this process is extremely hot and, therefore, as noted above, it is necessary to permit the powder to cool before further processing. Cooling, however, is greatly hindered because the powder metal is under a vacuum so that cooling can only proceed by conduction. It is, therefore, necessary to allow the powder to cool in storage containers for long periods, on the order of days, before it can be used in the hot isostatic pressing process. A more significant problem is that heating, even under the conditions described, can fail to remove enough of the gas to prevent porosity in the densified material.

The instant invention provides an apparatus and method for cleansing and degassing particulate material, such as powder metal, more efficiently than prior art methods. Additionally, the cleaned and degassed particulate material is processed at near ambient temperatures and, therefore, can be transferred immediately into a hot isostatic pressing container under a satisfactorily high vacuum.

In accordance with the foregoing, the apparatus of the instant invention includes a vacuum chamber which is connected to a suitable vacuum pump. The vacuum chamber includes means for generating an electric field. Contaminated particulate material is introduced into the chamber and an electric field is produced with electrically charges the contaminants to cause separation of the contaminants from the particulate material. The electric field also excites the contaminants, i.e., increases their velocity, to facilitate their removal by a vacuum pump. Removal of charged gaseous contaminants may be aided by means for urging the gaseous contaminants toward the outlet of the chamber to which the vacuum pump is connected. This is accomplished by providing a charged particle-attracting member consisting of a member having an electrical charge opposite to the charge on the gaseous contaminants. In this manner, the particulate material can be quickly and effectively stripped of gaseous and other contaminants, such as, argon gas and ceramic dust, and conducted at near room temperature into a container which may, if desired, be the final hot isostatic pressing container rather than a transport container.

Other advantages of the present invention will be readily appreciated as the same becomes better understood by reference to the following detailed description when considered in connection with the accompanying drawings wherein:

FIG. 1 is a cross-sectional, front elevational view of an apparatus for degassing particulate material constructed in accordance with the instant invention;

FIG. 1*a* is broken-away, cross-sectional view showing a detail of the apparatus shown in FIG. 1;

Figures 1, 1A:
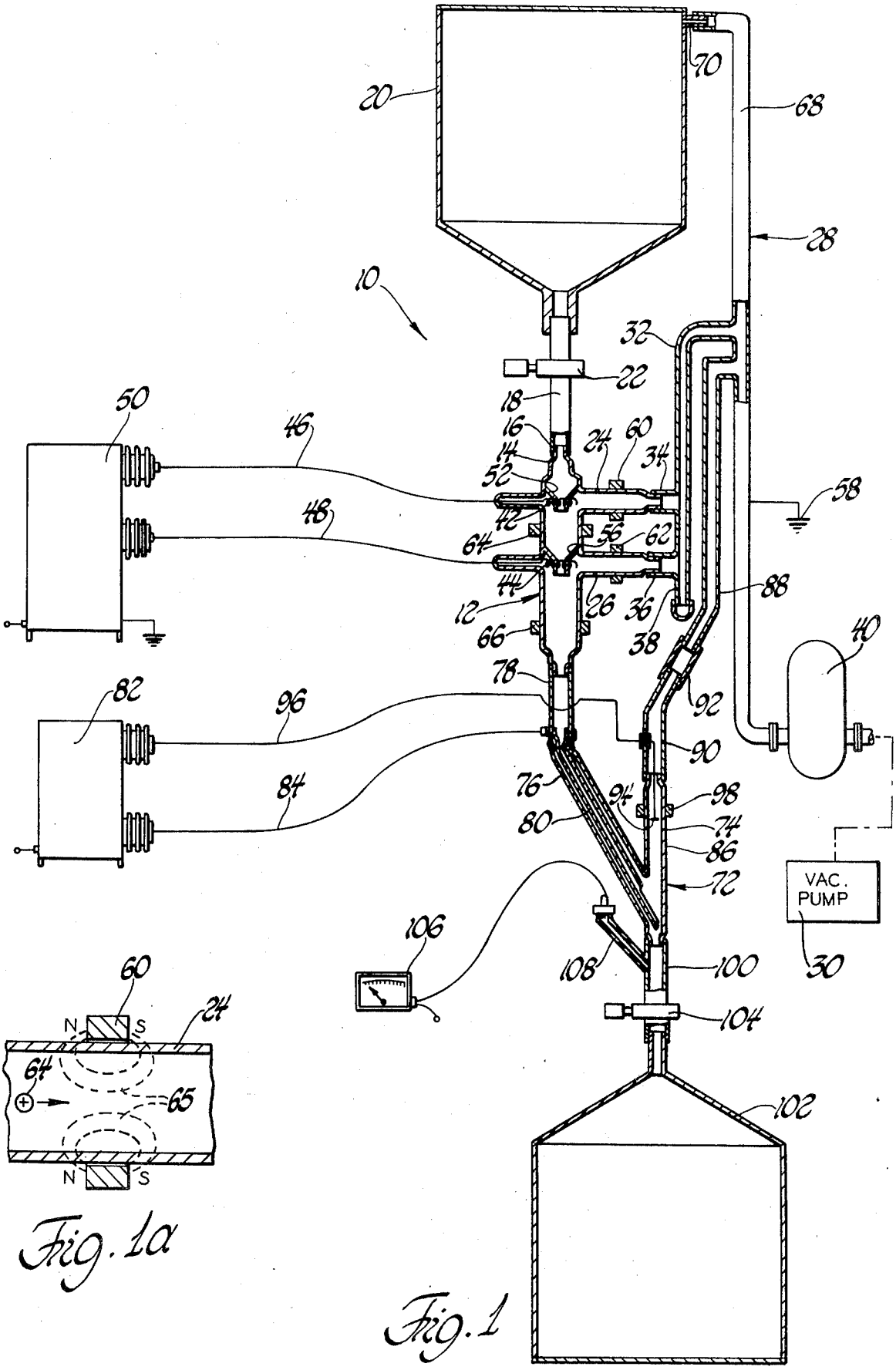

As set forth above, the instant invention provides a method and apparatus for cleaning and degassing particulate material, such as, powder metal, by subjecting the contaminated powder to an electric field. It has been discovered by the inventor that the use of an electric field to decontaminate powder metal produces much cleaner powder than prior art methods. Moreover, the cleaned powder metal recovered is at ambient temperature and can be used immediately in subsequent operations. As will be described in greater detail herein, either AC or DC power can be used to produce the electric field. Additionally, it has been found advantageous to produce and electric field of high enough intensity to ionize gaseous contaminants such as argon.

A number of theories have been developed to explain the manner in which the electric field cleans the powder. One theory is that the electric field produces a like electric charge in the individual particles and some gas atoms or molecules adhering to the surface of the particles. Since like charged objects repel one another, the gas is repelled from the particles. In this manner, the gas is positively separated from the metal particles. Once separated, the still charged gas is accelerated under the influence of the electric field. In other words, the gas is excited. The increased velocity of the gas increases the likelihood that the gas will find its way out of the vacuum chamber through the vacuum pump. Additionally, the powder particles pick up electrostatic charges while the powder is being made. Consequently, clusters of particles occur. These clusters tend to trap the gas so that it is difficult to separate the gas from the powder. It is felt that much of the argon gas which accompanies the powder to the hot isostatic pressing container is trapped in this fashion. By inducing a like charge in all of the particles of a cluster, the particles are repelled from each other and the argon gas is released. it is to be remembered that argon atoms, being inert, probably do not adhere to the particles, but move about. Once the clusters are broken up, the argon gas is free to move away from the particles.

The contaminated powder can be charged in different ways. In a DC system the powder can be brought into contact with one of the charged electrodes to induce a like charge in the particles. In either an AC or DC system which is operated at a potential sufficient to cause ionization of gaseous contaminants by cathodic discharge, electrons striking gas adhering to the particles are capable of knocking out outer shell electrons. The loss of electrons results in an overall positive charge in the particle and the gas since the loss of electrons is shared by both. Once charged, the gas is repelled from the particles. It has also been noted that the electric field immediately causes the particles to be repelled from one another thus breaking up clusters. It is felt that operating the system at potentials sufficient to ionize the argon gas is particularly advantageous. The nature of inert gases make it difficult to induce a charge in the atoms. However, the gas, in this case argon gas, can readily be charged by ionizing the gas. The ionized gas is then excited in the electric field and is more easily removed.

It is also theorized that, when the system is operated at potentials high enough to ionize the gaseous contaminants, a scrubbing action occurs. In other words, gas atoms, particularly the argon atoms, which have been ionized by collisions with electrons are accelerated by the electric field and collide with the powder particles. These collisions knock off other gas atoms which are attached to the surface of the particles. The gas atoms which are knocked off may then be ionized by collidions with electrons and are accelerated and collide with other particles. Since millions of atoms are involved in this process, the particles are, in effect, scrubbed by the colliding gas ions. It is noted that the electric field and the collisions also increase the velocity, i.e., activity, of the gaseous contaminants and, therefore, increase the likelihood that they will enter the vacuum pump system and be removed.

In order to further increase the likelihood that the gas contaminants will be removed, advantage is taken of the fact that the gas atoms are charged (either by ionization or by having an induced charge). In most cases, the gas atoms carry a positive charge, therefore, a negatively charged attracting member is employed to draw the charged particles toward the vacuum pump. The attracting member acts in a complimentary fashion to the increased activity of the gas atoms to further insure their removal from the vacuum chamber.

It is noted that the electric field not only removes the inert gas, bt may also separate the powder particles from other contaminants, such as, water vapor and ceramic dust, and as stated above, the powder particles are separated from each other. It has been observed that solid contaminants cling to the sides of the vacuum chamber. This is due, no doubt, to the fact that the sides of the chamber carry an induced charge which attracts the oppositely charged dust. In any event, it appears that such contaminants are separated from the powder and do not travel with the powder into the receiving container.

There is no positive indication which of the foregoing theories most accurately describes the process by which the powder is cleaned. It is possible that all play a role to some extent. In any event, it is known that by charging the contaminated particles in an electric field the contaminants can be separated from the powder and excited so that the gaseous contaminants can be more readily removed. The result is that cleaner powder can be produced. The attempted explanations are presented merely to aid in a complete understanding of the invention.

Although the apparatus described herein is designed to clean metal powder, it is recognized by the inventor that the basic concepts employed can be used to clean objects larger than the individual particles which make up the particulate material.

Referring now to the drawings, and particularly to FIG. 1, an apparatus for cleaning and degassing contaminated particulate material is shown generally at 10. The apparatus 10 includes a vacuum chamber, generally indicated at 12. The upper portion of the vacuum chamber consists of an elongated, hollow member 14 made of a dielectric material such as glass. The glass member 14 includes an inlet 16 at its upper end which is adapted for attachment to a conduit 18 which conducts contaminated powder metal from a transport container 20. The transport container is supported above the apparatus 10 by suitable framework (not shown) so that the particulate material, such as, a nickel base metal powder, can flow by gravity down the conduit 18 and through the inlet 16 to the vacuum chamber 12. A valve 22 is fitted in the conduit 18 for controlling the rate of powder flow into the vacuum chamber 12 and for opening and closing the transport container to the vacuum chamber.

The elongated hollow member 14 includes a pair of gas outlet tubes 24 and 26. As shown, these outlet tubes are integral extensions of the glass member 14 and communicate with the interior thereof. The outlet tubes 24 and 26 are connected to a vacuum manifold which is generally indicated at 28. The vacuum manifold 28 is part of an evacuation system for pumping down the vacuum chamber. The details of the evacuation system are not shown since such systems are well-known in the art. Suffice it to say, however, that the system includes a suitable vacuum pump 30 which is capable of producing a hard vacuum, i.e., a vacuum of 10 microns or less. For reasons to be explained herein, the vacuum manifold 28 is made of an electrically conductive material, such as, copper. One branch 32 of the manifold 28 includes a pair of nipples 34 and 36 which are joined to the ends of the gas outlets 24 and 26. The branch 32 is arranged generally vertically so that any solid particles which inadvertently enter the manifold 28 will drop by gravity into a trap 38 to prevent them from finding their way into the inner workings of the vacuum pump 30. Additionally, one or more filters, such as filter 40, is also provided for further insuring that solid foreign matter will not reach the vacuum pump 30.

Disposed within the hollow glass member 14 is a set of electrodes consisting of a pair of coils 42 and 44. The two coils 42 and 44 are connected by suitable electrical cables 46 and 48 to a source of electrical power, in this case, an alternating current electric generator 50. The coils 42 and 44 are disposed around the exterior of a pair of funnel-shaped portions 52 and 56 which are located within the hollow glass member 14. The funnel-shaped portions 52 and 56 serve a number of functions. The funnel-shaped portions 52 and 56 channel the flow of powder metal toward the center of the hollow glass member 14 to form a stream of powder metal which flows through the two coils 42 and 44. The funnel-shaped portions 52 and 56 also protect the coils from direct contact with the powder metal. Additionally, the funnel-shaped portions 52 and 56 are strategically located in front of the entrances to the gas outlets 24 and 26 to reduce the chance of powder particles being inadvertently deflected through the gas outlets 24 and 26 which could cause them to find their way into the vacuum system. This precaution is taken since, when operating at high voltages, the process evokes significant turbulence in the powder metal in the region between the coils 42 and 44. Any break-up of the stream due to turbulence is corrected when the powder particles are channeled through the lower funnel-shaped member 56.

The AC generator 50 is employed to produce an electric field between the coils 42 and 44. In the experimental prototype, the electric field produced is of sufficient potential to ionize the gaseous contaminants accompanying the powder metal flowing through the vacuum chamber 14. In other words, after the vacuum chamber 12 has been pumped down, the generator 50 is operated at a potential which will produce a cathodic discharge between the two coils. It has been found that adequate ionization can be accomplished by operating the generator at approximately 45 kv and 30 milliamps with the vacuum in the chamber 12 at about 5 – 10 microns. Under these conditions, the coils 42 and 44 emit a large number of electrons by cathodic discharge. The electrons are accelerated first toward one coil, then the other, as the polarity of the coils 42 and 44 changes. The rapidly moving electrons collide with gaseous atoms or molecules accompanying the powder metal. Many of these collisions result in knocking an electron out of the outer shell of the gaseous atom or molecule thus ionizing the same. Since the powder metal has been maintained under an inert atmosphere of argon gas, most of the contaminating gas accompanying the powder will be argon. Argon has a relatively high ionization potential, therefore, an electric field should be produced between the coils of sufficient potential to ionize argon gas. It has been found that a power level of about 45 kv causes adequate ionization of argon gas in the system employed, however, lower or higher power levels may be used. Since the ionization potential of argon is relatively high, other common types or contaminants, such as oxygen, hydrogen, and nitrogen, will also be ionized.

When the gas in the vacuum chamber has been ionized, the ions are excited by the electric field. As used herein, "excited" means the that the ions are accelerated, i.e., undergo an increase in kinetic energy. The increased velocity of the ions increases the likelihood that the ions will, by their increased random movement, enter the outlets 24 and 26. It may also be desirable to urge the ions toward the gas outlets 24 and 26 where they are more susceptible to removal by the vacuum system. For this purpose, the vacuum manifold 28 is maintained at a negative potential with respect to the positively charged gas ions. To accomplish this, the vacuum manifold 28 is grounded by means of a ground connection 58. The ground connection 58 does not produce merely a neutral ground, but maintains the manifold at a negative potential. The negatively charged vacuum manifold 28 thus attracts the positively charged gas ions thereby moving them through the outlets 24 and 26 into the vacuum manifold 28. In other words, the manifold 28 serves as an attracting member to the charged gas atoms. When the ions come into contact with the negatively charged surface of the vacuum manifold, the ions may pick up electrons and be neutralized; however, once the gas atoms are in the vacuum manifold 28 they have been effectively separated from the powder metal and there is little likelihood that they will find their way back to the vacuum chamber 12 to recontaminate the powder.

In order to help insure that the gas ions, once separated from the powder metal, will not recontaminate the powder metal, face polarized, annular magnets 60 and 62 are disposed around the outlets 24 and 26. The magnets are arranged to produce a magnetic field within the outlets as shown in FIG. 1*a*. FIG. 1*a* illustrates a portion of the outlet 24 and its face polarized annular magnet 60. The poles of the magnet are arranged such that the magnetic field produced attracts the positively charged ion 64 and moves it through the magnetic field from left to right. Movement of ions in the opposite direction is resisted since the ions experience a repulsive force when approaching the magnetic field from the right. In this manner, the magnet 60 functions as a oneway gate in that the magnetic field produced permits movement of the ions from left to right, but resists movement of such ions from right to left. Accordingly, once positively charged ions have passed through the magnets 60 and 62 toward the manifold 28 they are prevented from moving back in the direction of the vacuum chamber 14.

Additional face polarized magnets 64 and 66 may also be strategically located along the main body of the hollow glass member 14. The magnetic fields produced by these magnets aid in keeping charged gas atoms from passing downwardly through the vacuum chamber in the direction of powder flow. The magnets 64 and 66 function to maintain the gas ions in the region of the coils so that they are susceptible to the attractive force of the manifold 28. Although permanent magnets are employed for producing a magnetic field, it is obvious that a field of proper orientation can be produced by other means In fact, any low intensity directional electric field can be employed for controlling the movement of the charged gas atoms in the manner suggested by the use of the magnets. In short, it is only necessary to produce an electric field so that the positively charged ions will either be attracted or repelled as is necessary depending upon the location in the system and the desired direction of movement.

It has also been noticed that solids collect on the interior surface of the glass member 14. These solids are likely to be ceramic dust which has contaminated the powder during production. In testing the prototype equipment, the powder processed in the apparatus was produced by atomization. The atomization equipment includes ceramic parts, pieces of which can break off and enter the powder. Although very little of the ceramic dust has been observed, it is separated from the powder. It is theorized that the walls of the glass member 14 have an electrostatic charge induced in them thus accounting for the tendency of the oppositely charged solids to collect on the walls. In any event, the apparatus is effective to separate solid, as well as gaseous, contaminants from the powder.

In processing the powder, it has been found advantageous to produce a rough vacuum in the transport container 20. This is accomplished by connecting a branch 68 of the vacuum manifold 28 to a nipple 70 on the transport container 20. Prior to opening the valve 22 to permit flow of powder into the vacuum chamber 14, both the vacuum chamber 14 and the transport container 20 are pumped down. Of course, only a rough vacuum will be produced in the transport container 20 since quite a bit of argon will remain trapped by the powder. This remaining argon, however, along with other contaminants is removed as the powder passes through the electric field in the vacuum chamber 14.

Although it is quite possible to employ only the AC electric field, the apparatus includes a second region within the vacuum chamber 12 wherein the powder is subjected to another electric field. The second electric field insures that any gas which may not have been separated from the powder in the first region will be removed. The second region, generally indicated at 72, includes a Y-shaped member 74 made of a dielectric material, such as glass, as is the first member 14. One branch 76 of the Y-shaped member 74 is connected to the first member 14 by means of a sleeve 78 which is made of an electrically-conductive material, such as copper. An electrode 80 is joined to the sleeve 78 and extends downwardly from the sleeve 78 through the first arm 76 of the Y-shaped member 74. The electrode 80 is formed in the shape of a trough, or chute. The electrode 80 defines an extended transport surface over which the powder metal travels. The electrode 80 is connected to one terminal of a direct current electric generator 82 by means of an electrical cable 84. It is noted that any convenient source of direct current may be employed, but that in the experimental prototype a DC generator is used.

The second arm 86 of the Y-shaped member 74 communicates with another branch 88 of the vacuum manifold 28. A sleeve 90, which is made of electrically-conductive material, such as copper, is connected to the end of the arm 86. The sleeve 90 is in turn electrically isolated from the branch 88 of the manifold 28 by means of a glass sleeve 92, a non-conductor, which is interposed between the branch 88 and the copper sleeve 90. An electrode 94 may be located within the second arm 86. This electrode 94 is attached to the second terminal of the DC generator 82 through an electrical cable 96. Alternatively, the cable 96 may be attached directly to the copper sleeve 90 so that the sleeve 90 itself serves as an electrode and the electrode 94 may be dispensed with.

In one arrangement of the apparatus, the two electrodes 80 and 94 in the second region of the vacuum chamber were arranged such that the surface-defining electrode 80 was positively charged and the other electrode 94 was negatively charged. A voltage of 10 to 30 kv was applied across the two electrodes. Under these conditions, the difference in potential between the two electrodes is sufficient to cause a cathodic discharge. Accordingly, electrons break loose from the negative electrode 94 and stream toward the positive electrode 80. The powder is cleaned by two possible mechanisms. The electrons streaming toward the positive electrode 80 collide with the gas atoms remaining with the powder as the powder flows across the electrode. Consequently, the gas and powder receive a net positive charge and the ionized gas atoms are repelled and attracted toward the negative electrode. The positive electrode 80 also induces a like charge in any remaining clusters to release the gas trapped by them. The released gas is then susceptible to ionization. In any event the desired result obtained is that the powder and/or contaminants are electrically charged to cause separation of the contaminants from the powder. The apparatus has also been operated with the charges on the electrodes reversed. Adequate degassing was also observed.

After the powder falls through the first region of the vacuum chamber 12, the first region being generally defined by the glass member 14, the powder metal and any remaining contaminants enter the sleeve 78 and encounter the surface-defining electrode 80. The powder flows down the electrode 80 and is conveyed toward the intersection of the two arms 76 and 86 of the Y-shaped member 74. As explained above, since the powder is in direct contact with the positively charged electrode 80, a positive charge induced inducted in the powder and any gas adhering thereto. As the powder enters the intersection between the two arms, it is also bombarded by electrons being emitted from the negative electrode 94. The electrons collide with the gas and ionize the same and further charge the contaminants. The gas is, therefore, most likely repelled from the powder and is attracted upwardly through the second arm 86 of the Y-shaped member 74 since, as stated above, the vacuum manifold, including the branch 88, is maintained at a negative potential. Free moving argon atoms are also ionized and removed in the same manner. A face polarized magnet 98 may be disposed about the second arm 86 of the Y-shaped member 74 to serve as a one-way gate in the same manner as the previously described magnets.

The now essentially cleaned and degassed powder falls from the electrode 80 through a conduit 100 and into a receiving container 102. The conduit 100 is provided with a valve 104 for opening and closing the system to the receiving container 102. When the container is filled with degassed powder metal, the valve 104 is closed and the container 102 is sealed.

The experimental prototype of the degassing apparatus has been successfully operated using either one of the two fields, that is, using either the AC or DC electric field. Therefore, it is possible to build a degassing apparatus using either the AC field or the DC field or, as shown in FIG. 1, an apparatus may be employed using both types of fields. It is felt that the use of both fields is desirable to insure the most efficient degassing; however, for many purposes the level of degassification produced by using a single field is, no doubt, adequate. In any case, the use of an electric field in conjunction with a degassing operation has resulted in a much more superior product than degassing procedures used heretofore. In other words, the powder collected in thee receiving container 102 has a lower concentration of gaseous contaminants than powder produced by other degassing equipment. Additionally, however, the powder is substantially at ambient temperature and, therefore, further processing can take place immediately. In fact, the receiving container 102 may even be the actual hot isostatic pressing container which will be used in the consolidation step. It is to be remembered that direct loading of the powder metal into a hot isostatic pressing container has heretofore been difficult, if not impossible, when the powder has been degassed by a thermal process.

In order to monitor the degree of vacuum obtained within the receiving container 102 and in the vicinity thereof, a vacuum gauge 106 may be employed which is connected to a branch 108 of the conduit 100. In the apparatus, a vacuum gauge which measures the resistance of the environment within the system has been employed, however, any suitable vacuum gauge may be employed. It has been found that a vacuum of three to five microns in the receiving container 102 can easily be achieved by using the degassing apparatus described.

The degassing apparatus has been successfully employed to clean and degas metal powders of the superalloy type, such as, the well-known nickel base superalloy powder In 100. It is possible, however, that other types of metal powers, such as, stainless steel powders, can also be degassed in this manner. Of course, since steel powders are magnetic, it may not be possible to employ the magnetic one-way gates since the powder will be attracted to the magnets. This, however, is not a major drawback since the basic concept of subjecting the gas-contaminated powder to an electric field to charge gaseous contaminants can still be employed. As long as the gaseous contaminants are initially charged and then excited, they can be far more readily separated from the powder and removed by the vacuum system than systems which rely upon heating.

Of course, it should be appreciated that the specific design of the experimental prototype is not meant to suggest that the apparatus can only be built along these lines. Once the basics of the invention is appreciated by reference to the disclosure herein, other designs will be immediately apparent to those skilled in the art.

For example, an alternate embodiment of an apparatus for cleaning and degassing particulate material is shown in FIGS. 2 through 5. This version of the apparatus operates on the same basic principles as that described above, that is, degassification is accomplished by subjecting the contaminated particulate material to an electric field to charge and excite the gaseous contaminants. An important advantage of the second embodiment is the manner in which it is packaged. Additionally, the construction of the second embodiment eliminates many of the metal to glass connections which are prevalent in the first embodiment. Although not an impossible task, it is difficult to produce a hermetic seal between metal and glass sleeves. Hence, such connections are eliminated in the second embodiment by the novel manner of its construction. Moreover, the construction of the second embodiment results in a compact package which can be easily installed as a unit in preassembled form.

Figure 2:
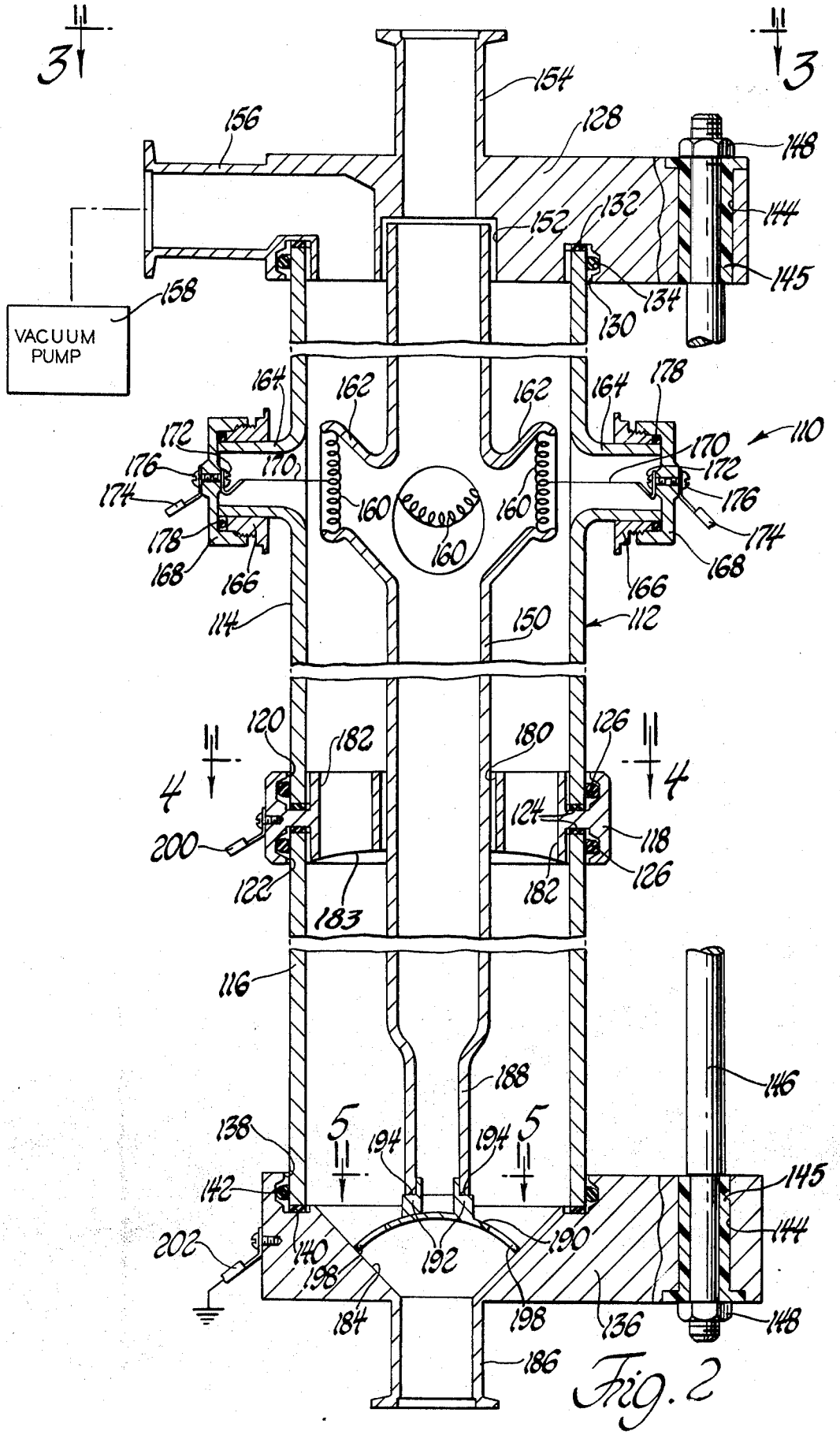
FIG. 2 is a cross-sectional, front elevational view of an alternate embodiment of a degassing apparatus for degassing particulate material constructed in accordance with the instant invention.
Figure 3:
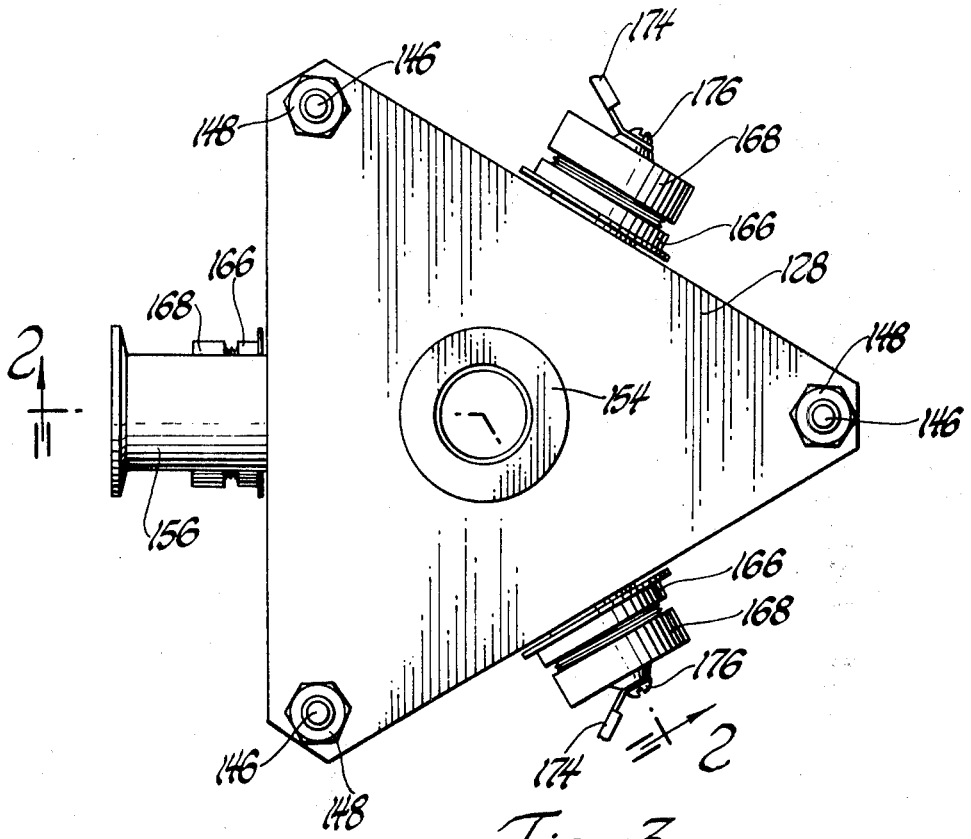
FIG. 3 is a plan view taken generally along line 3—3 of FIG. 2.
Figure 4:
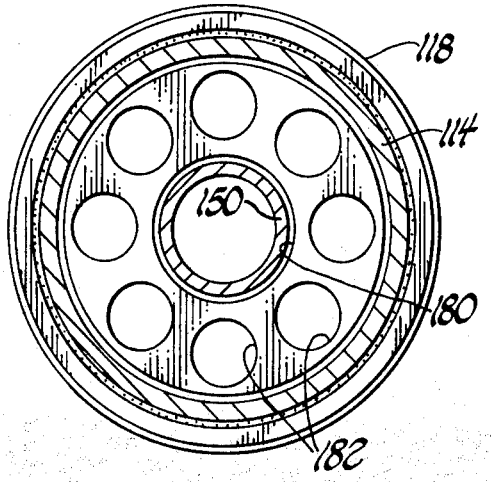
FIG. 4 is a transverse, cross-sectional view taken generally along line 4—4 of FIG. 2.

Referring more particularly to FIGS. 2 through 5, the apparatus, generally shown at 110, includes a vacuum chamber generally indicated at 112. The vacuum chamber 112 consists of a generally cylindrical sleeve which is formed by joining a pair of sections 114 and 116. The sections 114 and 116 of the sleeve are made of a dielectric material, such as, glass. In the embodiment shown, the sleeves are made of Pyrex, the trademark for a borosilicate glass made by an American manufacturer. Disposed between the sections 114 and 116 is an electrode 118, the purpose for which will be explained in greater detail herein. As shown in FIGS. 2 and 4, the electrode 118 is disc-shaped and includes inwardly extending grooves 120 and 122 on opposite sides thereof for receiving the ends of the glass sections 114 and 116. In order to hermetically seal the vacuum chamber at this juncture, sealing means, consisting of seals 124 and O-rings 126, are located within the annular grooves 120.

The other end of the upper section 114 is closed by means of an upper end cap 128. The end cap 128 includes an annular groove 130 for receiving the end of the upper section 114. This groove is also provided with sealing means consisting of a seal 132 and an O-ring 134 for hermetically sealing the end cap 128 to the glass section 114. A lower end cap 136 is provided for sealing the lower end of the lower glass section 116. The lower end cap 136 also includes an annular groove 138 which is provided with suitable sealing means consisting of a seal 140 and an O-ring 142.

As shown in FIG. 3, the upper and lower end caps 128 and 136 are triangularly shaped. The assembly is held together by three tie bars 146. For this purpose, each corner of the triangularly-shaped end caps 128 and 136 is provided with a bore 144 for receiving the threaded ends of tie bars 146. The bores 144 include insulating bushings 145 for electrically insulating the end caps one from the other. The ends of the tie bars 146 are threaded to receive nuts 148. The tie bars 146 are tensioned by means of the nuts 148 to draw the end caps 128 and 136 together, thus perfecting the seals between the sections 114 and 116 and the other elements.

Within the vacuum chamber 112 is disposed an elongated tube 150 which is supported between the end caps 128 and 136. The interior tube 150 is made of a dielectric material such as glass. In the preferred embodiment of the invention, the elongated interior tube 150 is made of Vycor, the trademark for a 96% silica glass made by an American manufacturer. As shown in FIG. 2, the upper end of the tube 150 seats in a bore 152 in the upper end cap 128. The upper end cap 128 is provided with an inlet 154 which communicates with the upper end of the tube 150 for introducing contaminated particulate material into the tube 150. The inlet 154 is adapted for attachment to a transport container, or the like, such as the transport container 20 shown in FIG. 1. The upper end cap 128 also includes a gas outlet 156 which communiates with the interior of the vacuum chamber 112. The gas outlet 156 is connected to a vacuum pump 158 through suitable plumbing (not shown).

As in the foregoing embodiment, electric field producing means is provided. Accordingly, a first, or upper region, of the vacuum chamber includes a set of electrodes which may consist of three coils 160. The three coils 160 are seated in three branches 162 of the tube 150. The branches 162 extend generally upwardly and outwardly from the body of the tube 150. Locating the coils 160 in this fashion protects them from direct impingement by the particulate material cascading down through the interior tube 150.

In order to supply electric power to the coils 160, the section 114 includes three nipples 164. Each of the nipples 164 carries an externally threaded collar 166 which is adapted to receive a threaded cap 168. The threaded cap 168 serves as a terminal for the coils 160 in that a wire 170 extends from the coil 160 to the cap 168 and is attached thereto by means of a screw 172. A lead wire 174 is connected to the exterior of the cap 168 by another screw 176. Leakage around the nipples is prevented by means of a seal 178. The leads 174 are connected to a source of alternating current, such as, an AC generator. In the event that three coils 160 are employed, three phase current may be used. A high voltage, low amperage current is supplied to the coils so that an electrical discharge will be produced when the vacuum chamber is partially evacuated. As in the first embodiment of the degassing apparatus, the charged coils 160 produce an electric field in the path of the particulate material. The electrical discharge from the coils, i.e., the rapidly moving electrons, cause ionization of the gaseous contaminants which results in separation of the contaminants from the particulate material.

It may be advantageous to generate another electric field in a second region of the vacuum chamber 112. The electric field in the second region is produced by employing the electrode 118. As shown in FIG. 2 and 4, the electrode 118 includes a central aperture 180 through which the interior tube 150 extends. The electrode 118 also includes a plurality of apertures 182 which permit free communication between the space in the upper and lower sleeve sections 114 and 116 surrounding the tube 150.

An important feature of the electrode 118 is that it includes a concave surface 183. When an applied voltage is sufficient to produce an electricl discharge, electrons are emitted from the negative electrode, i.e., the cathode. The electrons are emitted perpendicularly with respect to the cathode. Since the electrode 118 is intended to be the cathode, the surface 183 will emit electrons. By taking advantage of the known direction of travel of emitted electrons, the curvature of the surface 183, and its spacing from the positively charged electrode, can be varied so that the stream of electrons can be properly focused on the positively charged electrode.

Figure 5:
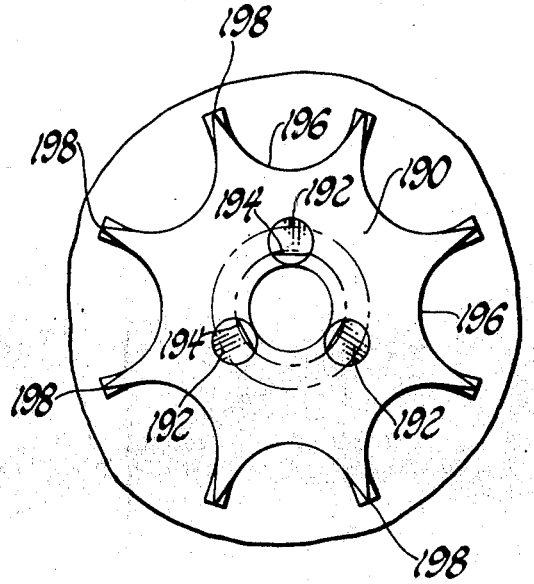
FIG. 5 is a broken-away, cross-sectional view taken generally along line 5—5 of FIG. 2.

The lower end cap 136 includes a tapered bore 184 which funnels the particulate material cascading down the tube 150 into an outlet 186. The outlet 186 is adapted for attachment to a receiving container (not shown) such as in the first embodiment described. The tube 150 includes a tapered end 188 which is partially closed by a dome-shaped member 190. As will be seen, the dome-shaped member 190 functions as a second electrode. As shown in FIG. 5, the dome-shaped member 190 includes three upwardly extending posts 192 which are notched as at 194 so that the posts 192 fit into the open end of the tube 150. The end of the tube 150, however, is spaced vertically from the upper surface of the dome-shaped electrode 190. The dome-shaped electrode 190 also includes arcuate cutouts 196 between legs 198 which define passages for permitting the particulate material to pass by the electrode 190 to the outlet 186. As shown, the legs 198 engage the sides of the tapered bore 184 of the end cap 136.

Particulate material, such as, powder metal, cascading down the interior tube 150 falls upon the top of the dome-shaped electrode 190 and flows outwardly through the spaces between the posts 192 across the surface of the dome-shaped electrode 190. As the particulate material flows across the electrode 190 it is exposed to the other electrode 118. The particulate material then falls off the dome-shaped electrode 190 through the arcuate cutouts 196 and falls through the outlet 186 into a receiving container. In short, the dome-shaped electrode 190 constitutes an extended transport surface over which the particulate material travels.

In order to produce an electric field, the electrode 118 is connected to the negative side of a suitable power source, such as, a DC generator by means of a wire lead 200. The lower end plate 136 is grounded through a wire lead 202 in order to maintain the end plate 136 at a positive potential. Since both the dome-shaped electrode 190 and the end plate 136 are made of an electrically-conductive material, such as copper, and the two members are in contact, the dome-shaped electrode 190 will be at the same potential as the end plate 136. The potential between the two electrodes may be sufficiently great to cause electrons to break away from the concave surface 183 of the electrode 118 and stream toward the dome-shaped electrode 190.

In operation, the system is pumped down by the vacuum pump 158 in the manner described in the first embodiment. Contaminated particulate material is then introduced through the inlet 154 and is permitted to cascade down the tube 150. The particulate material is subjected to an AC electrode field in the first region by the coils 160. In this region, gas atoms accompanying the particulate material are bombarded with electrons thus causing them to ionize. The charged gas atoms are repelled from the particles or ionized atoms knock gas atoms off the particles. The separated gas atoms are excited by the electric field and the chances that they will enter the vacuum system is increased. The upper end cap 128 may be maintained at a negative potential with respect to the ionized gas to draw the gas toward the vacuum system. This can be done by connecting the end cap 128 to ground or by grounding the plumbing of the vacuum system. Positively-charged gas atoms are attracted to the negatively charged end cap 128 through the branches 162 of the tube 150 and upwardly toward the gas outlet 156. It is noted that many variations can be designed using this concept since it is only necessary to provide some negatively charged member to serve as an attracting means. In short, the attracting means attracts the charged gas to the outlet 156 to facilitate its removal from the vacuum chamber by the vacuum pump 158.

The particulate material continues to cascade downwardly through the tube 150 and encounters the dome-shaped electrode 190. The particulate material flows across the surface through the posts 192 toward the cutouts 196. As pointed out above, the difference in potential between the two electrodes 118 and 190 may be high enough to cause electrons to stream downwardly from the negative electrode 118 toward the dome-shaped electrode 190. The electrons stream toward the surface of the dome-shaped electrode 190 and, therefore, strike and ionize any gas atoms remaining with the particulate material. Additionally, any remaining clusters are broken up by the electrical charge induced by the electrode 190 to release trapped gas so that it can be ionized. The ionized gas is attracted by the negatively charged electrode 118 and the negatively charged upper end cap 128. The ions are thereby accelerated upwardly through the passageway defined by the space between the exterior of the tube 150 and the interior of the sections 114 and 116. In the event that ions are neutralized by the electrode 118, they will, in any event be carried upwardly toward the outlet 156 by the mass flow of gas ions in an upward direction or will be reionized by the stream of electrons. Separation from the particulate material may also occur without ionization due to the charge induced in the gas and particulate material by the electrode 190. In any event, the gas will have little opportunity to rejoin the particulate material. The particulate material continues to flow toward the cutouts 196 where it falls off into the tapered bore 184. From there the particulate material flows through the outlet 186 into a receiving container (not shown). When the container is filled with substantially cleaned and degassed particulate material, which is at near ambient temperature, a valve (not shown) is closed and the filled, evacuated container is removed for further processing.

By way of summary, it is again pointed out that the two embodiments described are examples of the best mode of carrying out the teachings of the invention presently known to the inventor. Many other designs are possible. The basis of the invention consists of cleaning and degassing particulate material by subjecting the contaminated material to an electric field in a vacuum chamber. By this device, contaminants can be readily removed from the particulate material. Although the precise mechanism by which this occurs is subject to speculation, the beneficial results are indisputable.

As should be apparent, the invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

I claim:

1. An apparatus for cleaning contaminated particulate material which is at least in part contaminated by gaseous contaminants, said apparatus comprising: a vacuum chamber, vacuum pump means for evacuating said vacuum chamber, means for generating an electric field within said vacuum chamber, gas outlet means connected to said vacuum pump means through which gaseous contaminants can be removed from said vacuum chamber, inlet means for introducing gas contaminated particulate material into said vacuum chamber and for subjecting said particulate material to said electric field whereby said gaseous contaminants are electrically charged to cause separation of said gaseous contaminants from said particulate material and said gaseous contaminants are excited by said electric field to facilitate removal of said gaseous contaminants from said vacuum chamber through said gas outlet means, particulate material outlet means for conducting particulate material out of said chamber and means for receiving and collecting decontaminated particulate material through said particulate material outlet means and for maintaining said particulate material in a substantially decontaminated state.

2. An apparatus as set forth in claim 1 including means having a negative electrical charge for moving said charged gaseous contaminants away from said particulate material.

3. An apparatus as set forth in claim 1 wherein said electrical field generating means includes an electrode, said electrode including an extended surface over which contaminated particulate material travels whereby an electric charge is induced in said particulate material and said gaseous contaminants.

4. An apparatus as set forth in claim 1 including electrically charged means for moving the charged gaseous contaminants toward said gas outlet means to facilitate their removal from said vacuum chamber.

5. An apparatus as set forth in claim 4 wherein said electric field generating means generates an electric field of sufficient intensity to ionize gaseous contaminants.

6. An apparatus as set forth in claim 5 wherein said means for generating an electric field includes at least one set of spaced-apart electrodes and a source of electrical power connected to said electrodes.

7. An apparatus as set forth in claim 6 wherein said inlet means is located above said electrodes and positioned to conduct a stream of entering particulate material between said electrodes.

8. An apparatus as set forth in claim 7 wherein said particulate material outlet means is located below said inlet means for conducting particulate material to said receiving and collecting means.

9. An apparatus as set forth in claim 8 wherein said chamber includes a generally upright, elongated dielectric tube, said tube including a first region and second region, said means for generating an electric field including two sets of electrodes, one set being located in each of said first and second regions.

10. An apparatus as set forth in claim 9 wherein one of said set of electrodes includes an electrode having an extended surface over which the particulate material travels whereby an electric charge is induced in said particulate material and adhering contaminants.

11. An apparatus as set forth in claim 5 including gate means comprising means for producing a directional electric field at selected locations within said chamber for controlling the flow of charged gaseous contaminants therein.

12. An apparatus as set forth in claim 11 wherein said directional field producing means includes means for producing a magnetic field in which the magnetic flux lines permit charged gaseous contaminants to move through said magnetic field toward said gas outlet means and prevents such charged gaseous contaminants from moving through said magnetic field in the opposite direction.

13. An apparatus for degassing gas contaminated powder metal comprising: a vacuum chamber, vacuum pump means for evacuating said chamber, electric field producing means for producing an electric field within said vacuum chamber, gas outlet means connected to said vacuum pump means through which gaseous contaminants can be removed from said vacuum chamber, supply means for introducing gas contaminated powder metal into said vacuum chamber to subject the powder metal to said electric field to separate said gaseous contaminants from said powder metal and to increase their kinetic energy, powder outlet means for conducting powder out of said vacuum chamber and means for receiving and collecting degassed powder metal through said powder outlet means from said vacuum chamber and maintaining said powder metal in a substantially degassed state.

14. An apparatus as set forth in claim 15 including electrically charged means for moving charged contaminants away from said powder metal.

15. An apparatus as set forth in claim 13 wherein said electric field generating means includes an electrode, said electrode including an extended surface over which contaminated powder metal travels whereby an electric charge is induced in said powder metal.

16. An apparatus as set forth in claim 13 including a charged contaminant attracting member located adjacent said outlet means for moving charged gaseous contaminants toward said gas outlet means to facilitate their removal from said vacuum chamber.

17. An apparatus as set forth in claim 16 wherein said electric field generating means generates an electric field of sufficient intensity to ionize the gaseous contaminants.

18. An apparatus as set forth in claim 17 wherein said charged contaminant attracting member is maintained at a negative potential with respect to the ionized gaseous contaminants.

19. An apparatus as set forth in claim 18 wherein said means for generating an electric field includes at least one set of spaced-apart electrodes and a source of electrical power connected to said electrodes.

20. An apparatus as set forth in claim 19 including inlet means located above said electrodes and positioned to conduct a stream of entering particulate material between said electrodes.

21. An apparatus as set forth in claim 20 wherein said powder outlet means is located below said inlet means for conducting powder metal to said receiving and collecting means.

22. An apparatus as set forth in claim 21 wherein said chamber includes a generally upright, elongated dielectric tube, said tube including a first region and second region, said means for generating an electric field includes two sets of said field producing electrodes.

23. An apparatus as set forth in claim 22 wherein one of said sets of electrodes includes an electrode including an extended surface over which the powder metal travels whereby an electric charge is induced in said powder metal.

24. An apparatus as set forth in claim 16 including gate means comprising means for producing a directional electric field at selected locations within said chamber for controlling the flow of charged gaseous contaminants therein.

25. An apparatus as set forth in claim 24 wherein said directional field producing means includes means for producing a magnetic field in which the magnetic flux lines permit charged gaseous contaminants to move through said magnetic field toward said gas outlet means and prevent such charged gaseous contaminants from moving through said magnetic field in the opposite direction.

26. An apparatus for degassing gas contaminated particulate material comprising: a vacuum chamber including a generally cylindrical sleeve, an end cap at each end of said sleeve, said end caps having a groove for receiving the ends of said sleeve, sealing means in said grooves, and tie bars between said end caps tensioned to perfect the seal between said sleeve and said end caps; one of said caps including an inlet for introducing a gas contaminated particulate material into said chamber and a gas outlet for removing gaseous contaminants from said chamber and the other of said caps including an outlet for removing essentially degassed particulate material from said chamber, vacuum pump means connected to said gas outlet for evacuating said vacuum chamber, electric field producing means for producing an electric field within said vacuum chamber to charge and excite any gaseous contaminants thereby separating the charged gaseous contaminants from the particulate material and facilitating their removal through said gas outlet.

27. An apparatus as set forth in claim 26 wherein said sleeve includes two sections and said electric field producing means includes an electrode supported between said sections, said electrode including oppositely facing grooves for receiving the ends of said sections and sealing means in said grooves.

28. An apparatus as set forth in claim 27 including an interior tube supported between said end caps having an inlet end communicating with said inlet for conducting the particulate material through said vacuum chamber.

29. An apparatus as set forth in claim 28 wherein said interior tube includes outwardly extending branches and said electric field producing means includes a plurality of said electrodes, and one of said electrodes mounted in each of said branches.

30. An apparatus as set forth in claim 29 wherein said electrode supported between said end caps includes a curved emitting surface for preferentially directing a stream of electrons emitted therefrom.

31. An apparatus as set forth in claim 30 wherein said electric field producing means includes an electrode located at the outlet end of said interior tube.

32. An apparatus as set forth in claim 31 wherein said electrode at the outlet end of said interior tube includes an extended surface over which said particulate material travels.

33. An apparatus as set forth in claim 32 wherein said last-named electrode includes passages for permitting particulate material to pass thereby into said particulate material outlet.

34. An apparatus as set forth in claim 33 including attracting means for moving charged contaminants away from the particulate material including a member having a negative charge.

35. A method for degassing gas contaminated particulate material comprising the steps of:

a. introducing gas-contaminated particulate material into a vacuum chamber which is being continuously evacuated by a vacuum pump,
b. subjecting the gas-contaminated particulate material to an electric field to charge the gaseous contaminants thus causing them to separate from the particulate material,
c. removing the charged gaseous contaminants from the vacuum chamber, and
d. collecting the essentially decontaminated particulate material and maintaining the same in a substantially decontaminated state.

36. A method of cleaning and degassing contaminated powder metal consisting of the steps of:

a. introducing contaminated powder metal into a vacuum chamber,
b. subjecting the powder metal to an electric field to charge the powder and contaminants to separate the contaminants therefrom and
c. simultaneously evacuating the vacuum chamber by means of a suitable vacuum pump to remove separated contaminants.

37. The method of claim 36 including the steps of conducting the decontaminated powder metal out of the vacuum chamber and receiving and collecting the same in a container capable of maintaining the powder metal in a substantially decontaminated state.

38. The method of claim 36 including the step of attracting charged contaminants toward the vacuum pump by means of a member having an opposite charge with respect to the charged contaminants.

* * * * *

UNITED STATES PATENT OFFICE
CERTIFICATE OF CORRECTION

PATENT NO. : 4,056,368
DATED : Nov. 1, 1977
INVENTOR(S) : Walter J. Rozmus

It is certified that error appears in the above-identified patent and that said Letters Patent are hereby corrected as shown below:

Column 1, line 35, "and" should be --an--. Column 2, line 2, "cleansing" should be --cleaning--. Column 2, line 14, "with" should be --which--. Column 3, line 19, "it" should be --It--. Column 3, line 54, "dions" should be --sions--. Column 4, line 5, "bt" should be --but--. Column 8, line 29, "induced inducted" should be --is induced--. Column 8, line 65, "thee" should be --the--. Column 9, line 23, "In" should be --IN--. Column 9, line 24, "powers" should be --powders--. Column 12, line 22, "electrode" should be --electric--. Column 14, Claim 10, line 29, "one of said set" should be --one of said sets--. Column 14, Claim 14, line 63, "as set forth in claim 15" should be --as set forth in claim 13--.

Signed and Sealed this
Fourth Day of April 1978

[SEAL]

Attest:

RUTH C. MASON
Attesting Officer

LUTRELLE F. PARKER
Acting Commissioner of Patents and Trademarks